United States Patent [19]

Gelbard

[11] Patent Number: 4,537,330

[45] Date of Patent: Aug. 27, 1985

[54] BAG DISPENSING SYSTEM

[75] Inventor: Edward Gelbard, Monte Carlo, Monaco

[73] Assignee: Wilverly Mansions I.B.V., Netherlands

[21] Appl. No.: 481,460

[22] Filed: Apr. 1, 1983

[51] Int. Cl.[3] ..... B65D 83/00

[52] U.S. Cl. ..... 221/26; 221/45; 221/302; 221/305

[58] Field of Search ..... 221/26, 302, 305, 45–46; 206/554; 211/57.1, 54.1, 59.1; 248/95

[56] References Cited

U.S. PATENT DOCUMENTS

| | | | |
|---|---|---|---|
| 225,025 | 1/1880 | Roberts | 211/57.1 X |
| 1,469,162 | 9/1923 | Lesler | 221/26 X |
| 2,007,461 | 7/1935 | Shelley | 221/26 |
| 3,341,003 | 9/1967 | Marsh | 221/26 X |

FOREIGN PATENT DOCUMENTS

| | | | |
|---|---|---|---|
| 1915119 | 10/1970 | Fed. Rep. of Germany | 221/26 |
| 2035264 | 6/1980 | United Kingdom | 221/26 |

*Primary Examiner*—Charles A. Marmor
*Attorney, Agent, or Firm*—Darby & Darby

[57] ABSTRACT

A dispenser for plastic bags comprises two side panels, top and bottom panels and a back panel forming a rigid container. A front panel is hingedly connected to the bottom panel for closing the container. The front panel is formed with a perforated pull-out in the mid to lower portion whereof to expose the interior of the container. A generally U-shaped hanger has a base lying outside the container near the top thereof to facilitate securing the container to an outside support and has a pair of arms passing through and secured by the back and front panels near the respective tops thereof. The arms are adapted to pass through holes formed in the bindings of pads of plastic bags to support the pads within the container. When the pads of bags are thus supported within the container and the perforated pull-out is opened, the bags can be conveniently removed singly by users.

1 Claim, 6 Drawing Figures

BAG DISPENSING SYSTEM

FIELD OF THE INVENTION

This invention pertains to a bag dispensing system that simplifies the utilization of plastic bags packaged in large quantities. The system acts both as a dispenser in a retail or industrial setting and as a shipping container for plastic bags.

BACKGROUND OF THE INVENTION

The plastic bag has revolutionized product packaging at the industrial and consumer level. However, plastic bags present some problems when dispensed from their own packaging. Plastic bags are slippery to the touch and are generally hard to handle until something has been put into them. There is generally little friction between the walls of adjacent bags, making the bags difficult to maneuver and control when several are placed together.

One attempt to alleviate this problem has been to dispense the bags in the form of a roll. In the roll dispensing method, plastic bags are formed from a continuous tube of plastic. Heat seals and perforations at intervals form individual bags. When a bag is to be dispensed, the main portion of the bag is held and torn along the perforations that secure the bag to the remainder of the roll. This system is well known and found in the produce departments of many supermarkets. However, with this type of dispensing system, the plastic bag must be relatively thin and constructed of a plastic having a high resiliency and stretchability to enable the plastic to be slightly stretched as the roll is constructed in order to maintain a stable roll.

If the plastic bags are not rolled tightly, the roll tends to fall apart. This presents several problems to the consumer attempting to obtain a bag from such a roll. First, it is difficult to peel such a bag from the roll because the presence of static electricity and thinness of each layer make it difficult to lift the end of the roll away from the surface. Two hands are generally required to remove a bag from the roll, one to start a perforation tear and another to retain the next bag in the roll, allowing the first bag to be removed.

Another system used when large quantities of bags are required is simply a cardboard box containing many plastic bags stacked one over the other. The physical characteristics of the plastic generally make this system inconvenient in that the plastic bags settle during shipping and are hard to handle once the box has been opened because of the slippery nature of the plastic.

In order to alleviate this problem, bags have been assembled by bindings into pads, generally of 50–100 bags each. The bags are heat sealed together, and perforations are provided for separating one bag from the remainder of the pad. These pads are generally preferred to the single bag packaging system because the bags are more manageable. However, the pads cannot be assembled in a thickness much greater than 100 bags. This is an insufficient quantity for typical retail use and hence a multi-pad system is generally necessary.

SUMMARY OF THE INVENTION

It is an object of the present invention to provide a bag dispensing system that is quick and easy to use and inexpensive. It is another object of the present invention to provide a plastic bag dispensing system that is formed directly from the packaging for the plastic bags, requiring little set-up and no assembly. It is yet another object to provide a dispensing system that is refillable.

The foregoing and other objects are attained by providing a dispenser for plastic bags comprising two side panels, top and bottom panels and a back panel forming a rigid container. A front panel is hingedly connected to the bottom panel for closing the container. The front panel is formed with a perforated pull-out in the mid to lower portion thereof for exposing the interior of the container. A generally U-shaped hanger has a base lying outside the container near the top thereof to facilitate securing the container to an outside support and has a pair of arms passing through and secured by the back and front panels near the respective tops thereof. The arms are adapted to pass through holes formed in the bindings of pads of plastic bags to support the pads within the container. When the pads of bags are thus supported within the container and the perforated pull-out is opened, the bags can conveniently be removed singly by users.

BRIEF DESCRIPTION OF THE DRAWINGS

A better understanding of the invention may be gained from the following description of the preferred embodiments thereof, taken in conjunction with the appended drawings, in which.

DESCRIPTION OF THE PREFERRED EMBODIMENTS

The invention is not limited to the details of construction and arrangement of parts illustrated in the accompanying drawings, since the invention is capable of other embodiments and of being practiced or carried out in various ways. Also, the phraseology or terminology employed herein is for the purpose of description and not limitation.

Figure 1:
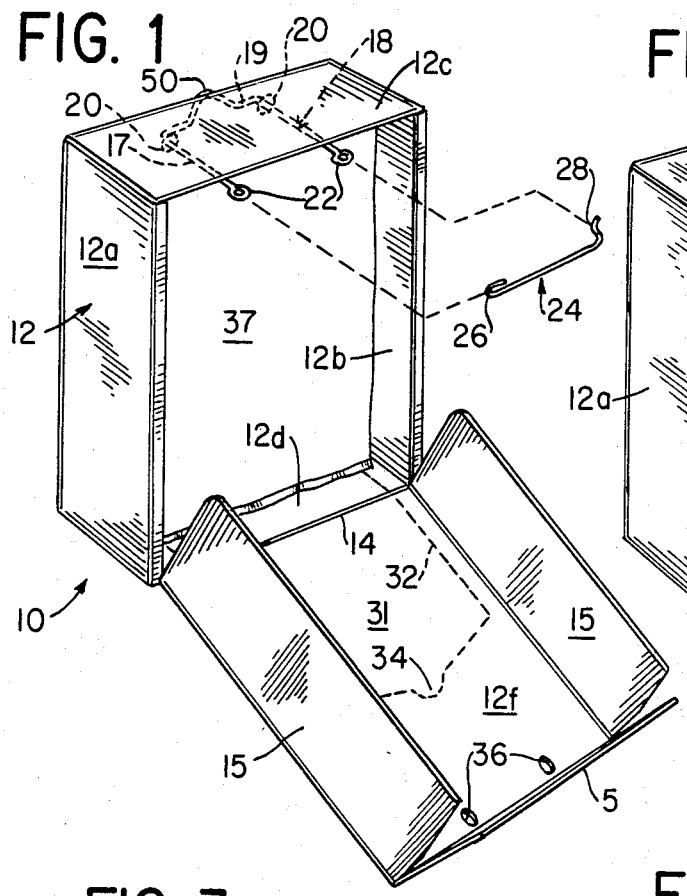
FIG. 1 is a perspective view of a preferred embodiment of a dispenser constructed in accordance with the invention and showing the dispenser in the open position.
Figure 2:
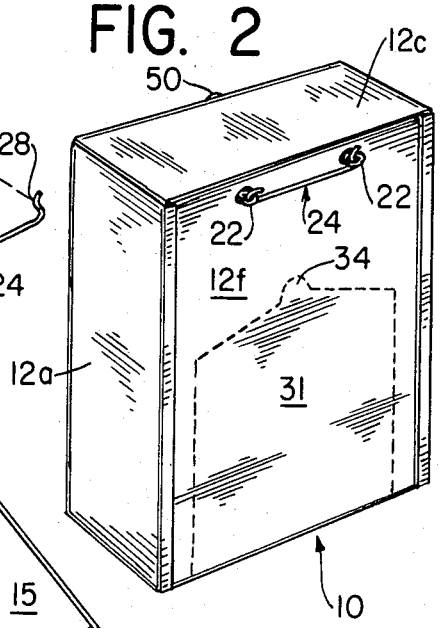
FIG. 2 is a perspective view of the dispenser of FIG. 1 in the closed position in which it serves as a shipping container.
Figure 5:
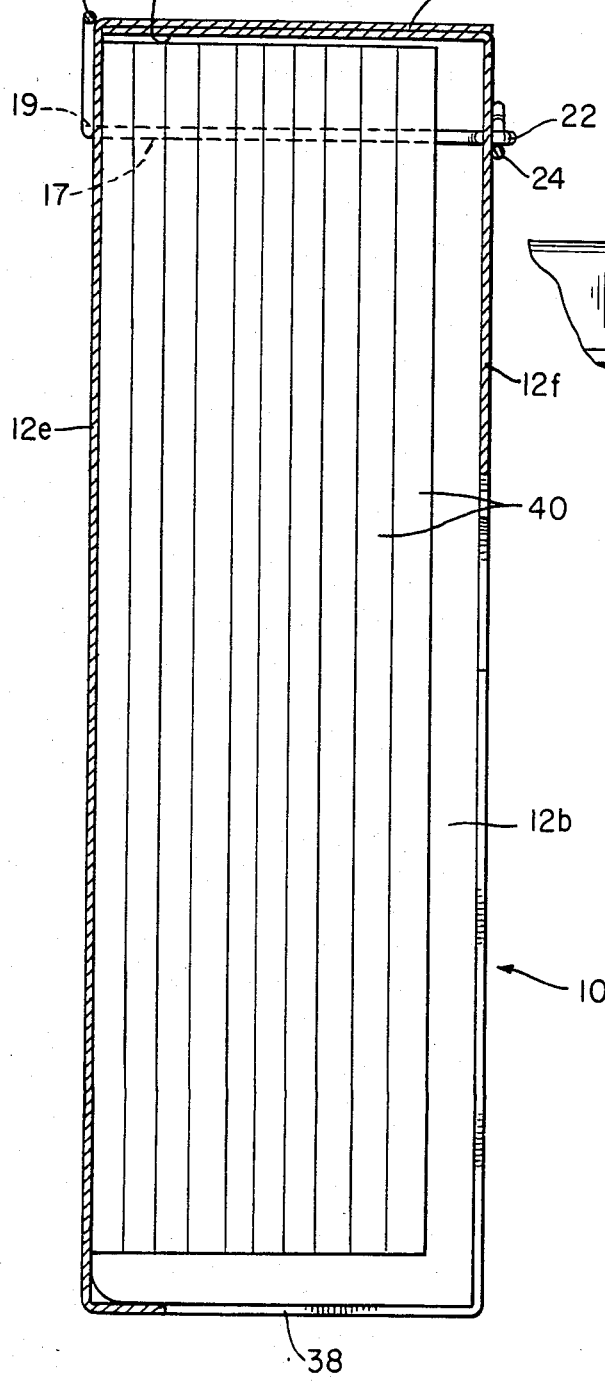
FIG. 5 is a longitudinal cross section on a larger scale taken along the line 5—5 of FIG. 3, looking in the direction of the arrows and showing the arrangement of the pads of FIG. 4 within the container.

FIG. 1 shows a dispenser 10 partially assembled. It comprises a container 12 which is rigid and rectangular and has two side panels **12*a* and 12*b*, top and bottom panels 12*c* and 12*d*, and a back panel 12*e* (visible in FIG. 5). A front panel 12*f* extends from a crease or hinge 14 to form a closure creating a six-walled container. Side flaps 15 lie along the inner walls 12*a* and 12*b* of the container 12 when the front panel 12*f*** is in the closed position.

Two openings 20 in the back panel **12*e* allow the two arms 17 of a U-shaped bracket or hanger 18 to pass through into the interior of the container 12. A stop portion or base 19 of the U is approximately as long as the distance between the openings 20 and is continuous with each of the arms 17. At the end of each arm 17 opposite the base 19 is an eyelet 22**.

The arms 17 of the hanger 18 pass through the openings 20 in the back panel 12*e* as far as permitted by the base 19. Further movement in that direction is blocked when the base 19 comes into contact with the exterior of the rear panel 12*e*.

A hook 26 on a retainer 24 is engageable in one eyelet 22. The other end of the retainer 24 is bent into an S-shaped snap 28 and allows the retainer 24 to snap securely into position when the S-shaped end of the retainer 24 is pushed through the associated eyelet 22.

A perforated edge 32 forms a closed curve over the mid to lower portion of the front flap 12*f* and the bottom wall 12*d*. A thumb press area 34 is provided as part of the closed curve of perforations. Two openings 36 in the front panel 12*f* are provided directly opposite the openings 20 of the rear panel 12*e*.

Figure 4:
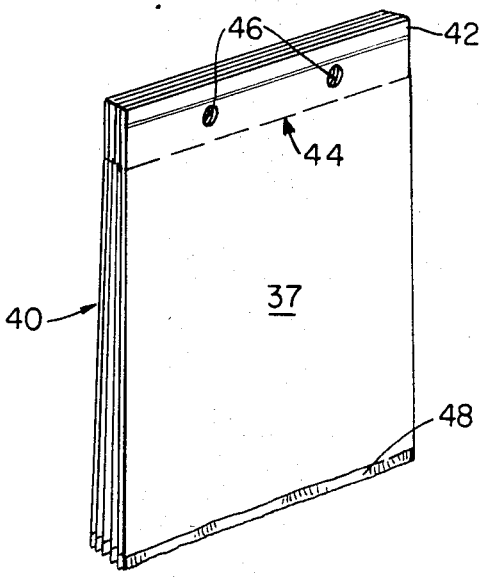
FIG. 4 is a perspective view of a pad of bags for use in a dispenser according to the invention.

The dispenser 10 is designed to dispense polyethylene plastic bags. FIG. 4 shows the bags 37 provided in a tablet or pad 40 comprising approximately 50–100 bags. To form the pad 40, a plurality of flattened plastic tubes are stacked together with their axes aligned. A single heat seal 42 closes one end of each tube and couples the tubes together. The other end of each tube is closed by separate heat seals 48. Perforations 44 are provided between the heat seals 42 and 48 to permit removal of the bags one at a time from the pad 40 and provide an opening for each bag 37 when it is removed. Between the perforations 44 and the pad seals 42, two openings 46 are provided through the entire pad 40. The distance between the two openings 46 is approximately equal to the distance between the two openings 20 in the rear panel 12*e* or the distance between the two openings 36 in the front panel 12*f*.

The dispenser 10 provides a convenient, strong, simple and refillable system for packing, shipping and dispensing plastic bags.

To pack the bags into the system, the front panel 12*f* is opened to expose the inside of the container 12. The hanger 18 is then mounted on the carton from the exterior of the rear panel 12*e*. A plurality of pads 40 of bags are then mounted on the arms 17 by passing the pad openings 46 thereover.

After the container 12 has been packed with the desired number of pads 40, the front panel 12*f* is closed, the flaps 15 being tucked into the interior of the container 12. When the front panel 12*f* has been closed, the eyelets 22 of the hanger 18 protrude through the openings 36 in the front panel 12*f* to the exterior of the container 12. The retainer 24 is then secured to the eyelets 22 as described above. In this manner, the sealed container 12 is provided with bags packed in a simple, quick and efficient manner. The contents of the container 12 are well secured and will not be disrupted or settle during shipping.

The design of the hanger 18 and associated retainer 24 is such that the packed containers 12 may be stacked one on another without any significant protrusions to damage the containers or cause an unstable stack.

Figure 3:
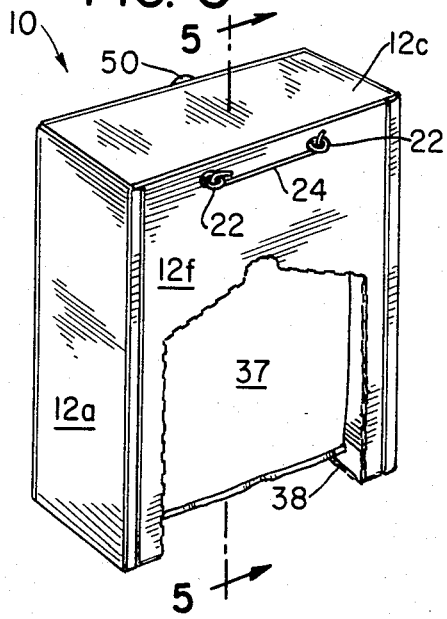
FIG. 3 is a perspective view of the dispenser in use.

When the sealed container 12 with the bags is received by the end user, it is converted from a shipping carton to a dispensing unit merely by removing the perforated pull-out 31 that is surrounded by perforations 32. This procedure is made more convenient by providing the thumb tab 34. When the perforated pull-out 31 is removed, an opening is provided having a serrated edge 38 (FIG. 3). The dispenser 10 can now be placed into position. If a flat surface is provided, the dispenser 10 is self-standing. The unit can also be secured to a wall or another vertically-oriented surface. This is an important advantage of the present invention because when situated vertically, valuable horizontal merchandising space is saved.

Figure 6:
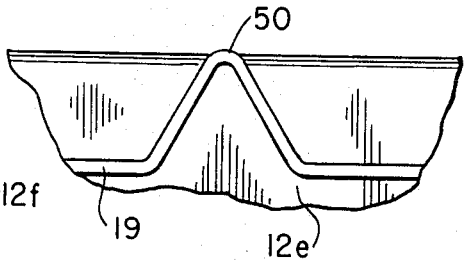
FIG. 6 is a rear elevational view on a still larger scale of a portion of the dispenser including means for hanging the dispenser on a separate support.

FIG. 6 shows the base 19 of the hanger 18 provided with an inverted V shape 50 constituting a catch. A small protrusion extending from the wall or other vertically-oriented surface that can support the weight of the dispensing system is used as the receiving point for the vertex of the catch 50.

To use the dispenser 10, one merely reaches into the carton 12 with one hand and applies a slight downward force on the bag closest to the opening which appears when the perforated pull-out 31 is removed. The hanger 18 provides the resistive force, and perforations 44 securing the bag to the pad 40 (FIG. 4) yield to the force applied and thus dispense the bag. Of course, the other bags remain attached to the pad 40 and within the dispenser 10.

If the user does not require a system containing a large number of bags, the carton 12 can be placed in storage and individual pads 40 can be removed as needed and then either hung on a nail in a wall, for example, or placed on a countertop, so that individual bags can be removed from the pad as needed.

The removable hanger 18 and retainer 24 can be constructed from any suitable material such as wire, sheet metal, plastic, and the like. In addition, any suitable removable clip may be employed.

Thus there is provided in accordance with the invention a novel and highly-effective dispenser which serves also as a shipping container for plastic bags. Many modifications of the preferred embodiments of the invention disclosed herein will readily occur to those skilled in the art. Accordingly, the invention is to be construed as including all structures which fall within the scope of the appended claims.

What is claimed is:

1. A dispenser for plastic bags comprising two side panels, top and bottom panels and back panel forming a rigid container, a front panel hingedly connected to said bottom panel for closing said container, said front panel having flaps hingedly connected to the sides not connected to said bottom panel, each flap being approximately as long as its respective side and being approximately as wide as said side and top panels for supporting said front panel when said container is closed, said front panel being formed with a rectangular-shaped perforated pull-out extending from the mid to lower portion thereof and into said bottom panel for exposing the interior of said container, the upper side of said rectangular-shaped pull-out being in the shape of a wide inverted V, and having a thumb-press portion provided at the vertex of the V, to facilitate initiation of perforation rupture, a generally U-shaped hanger having a base lying outside said container near the top thereof to facilitate securing said container to an outside support, said base having a portion in the shape of an inverted V to facilitate hanging said dispenser and having a pair of arms passing through and secured by said back and front panels near the respective tops thereof, said arms being formed with eyelets at their ends remote from said base, said eyelets lying outside said container and said arms being adapted to pass through holes formed in the bindings of pads of plastic bags to support said pads within said container, and a retainer formed with a pair of hooks respectively engageable in said eyelets, at least one of said hooks being S-shaped for snapping said retainer into engagement with said eyelets, whereby, when said pads of bags are thus supported within said container and said perforated pull-out is opened, said bags can conveniently be removed singly by users.

* * * * *